United States Patent [19]

Gill

[11] 4,205,764

[45] Jun. 3, 1980

[54] HOLDER FOR A TUBE WRINGING DEVICE

[76] Inventor: John B. Gill, 519 Shire Ct., Eugene, Oreg. 97401

[21] Appl. No.: 958,174

[22] Filed: Nov. 6, 1978

[51] Int. Cl.[2] ..... B65D 35/56

[52] U.S. Cl. ..... 222/105; 222/181; 248/316 B

[58] Field of Search ..... 222/95–105, 222/180, 181, 185; 248/222.1, 316 B, 316 E

[56] References Cited

U.S. PATENT DOCUMENTS

| | | | |
|---|---|---|---|
| 1,859,174 | 5/1932 | Sassano | 222/102 |
| 2,874,525 | 2/1959 | Kirkpatrick et al. | 222/105 |
| 3,353,775 | 11/1967 | Sebo | 248/316 B |
| 3,586,213 | 6/1971 | Gill | 222/102 |
| 4,108,413 | 8/1978 | Goserund | 248/316 |

*Primary Examiner*—H. Grant Skaggs

*Attorney, Agent, or Firm*—James D. Givnan, Jr.

[57] ABSTRACT

A holder including a base for platform mounting. The base includes a clamp for securing a tube wringing device thereon. One handle of the tube wringing device is adjustably confined by a latch on the base which exerts pressure on the handle and a roller thereon urging the roller into engagement with a remaining roller and a tube therebetween. The latch may be resiliently mounted so as to yield during roller operation.

8 Claims, 5 Drawing Figures

HOLDER FOR A TUBE WRINGING DEVICE

BACKGROUND OF THE INVENTION

The present invention pertains generally to a holder for adjustably mounting a tube wringing device to permit single handed operation of the device.

The tube wringing device disclosed in U.S. Pat. No. 3,586,213, and modified forms thereof, have been in wide use in the United States and abroad. Briefly, the tube wringing device comprises a pair of toothed rollers each carried by a handle frame with the handle frames pivotally joined to permit closing of the rollers into engagement against a collapsible tube preliminary to incremental passage of the tube by roller rotation to expel tube contents. The handle frames each include a handle grip, remotely disposed from the rollers, for grasping by one hand manually biasing of the coacting rollers toward one another to assure full collapsing of the tube during passage therepast. A turning key is provided on one of the rollers for finger actuation. Accordingly, the tube wringing device as disclosed in the above patent requires both of the user's hands for operation. The two handed operation of the tube wringing device is entirely satisfactory for the majority of uses which may range from the collapsing of toothpaste tubes to tubes containing caulking material, adhesives, dental impression material, oil paints, etc.,. A need has arisen for one handed operation of the tube wringing device to permit the operator to manually hold and position the article onto which the tube contents are being applied. For example, certain electronic and electrical assembly work dictates that a minute amount of tube contained material be precisely applied to the work. Such is extremely difficult when the tube wringing device is manually held.

SUMMARY OF THE PRESENT INVENTION

The present invention is embodied within a holder for adjustable biased engagement with the grip components of a tube wringing device.

The present holder includes a base attachable to a supporting platform which may be upright or horizontal to best suit the task at hand. The base is adapted to receive a clamp which firmly engages a portion of the tube wringer to hold same securely in place on the base. A latch is in adjustable engagement with the base so as to be adjustable toward and away from the base to exert different degrees of force on the grips of the tube wringer frame. By utilizing a threaded connection between the latch and base, latch positioning toward the base may be in increments of thousandths of an inch to permit application of the desired force to the grips. One form of the holder resiliently mounts the latch to permit axial latch movement within a limited range during roller operation. Accordingly, the rollers are yieldably positioned relative one another and may move away from each other during passage of a thicker than normal portion of the tube. Also, this feature compensates for any slight eccentricity of the rollers. The yieldable latch feature is accomplished by an internally threaded member movably mounted within the base with such movement being against a resilient member such as a spring washer or elastomeric ring.

Important objectives of the present invention include the provision of a holder for a tube wringing device which permits the device to be operated with a single hand enabling the user to manually position the material receiving article adjacent a tube spout for precise application of tube contents to the article; the provision of a holder having a latch component adjustably contactible with grips of the tube wringer in fine increments; the provision of a latch component which is yieldably mounted on its base enabling limited movement of the latch and a grip of the wringer device during a tube wringing operation; the provision of a holder within which collapsible tubes may be readily installed and removed.

DETAILED DESCRIPTION OF THE PREFERRED EMBODIMENTS

Figure 1:
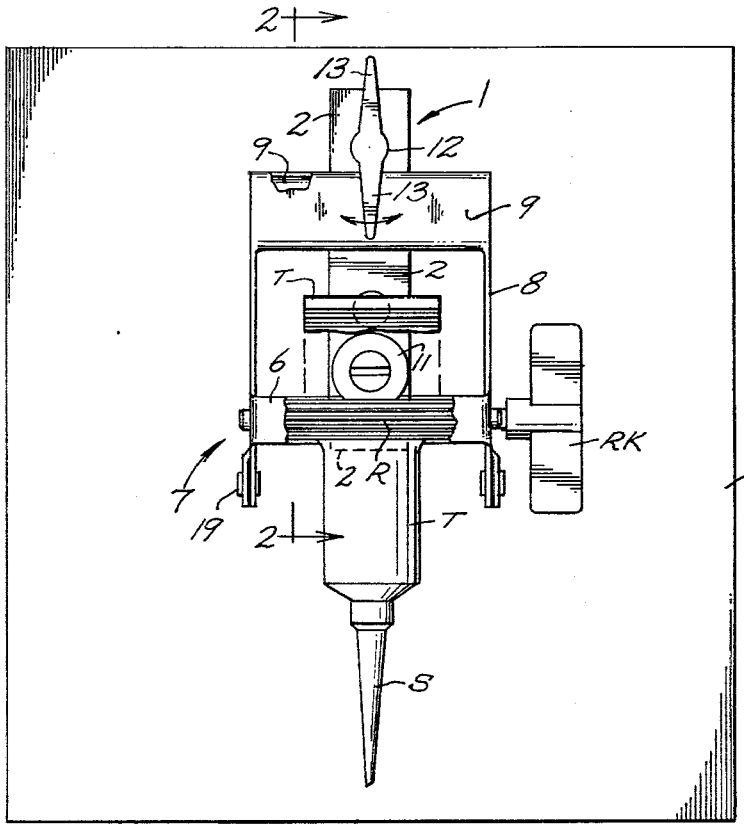
FIG. 1 is an elevational view of the present holder in place on a vertical support showing a tube wringing device and partially collapsed tube therein.

With continuing attention to the drawing, the reference numeral 1 indicates generally the present holder invention which is secured to a platform P which may be supported vertically or horizontally to best suit the job at hand. The platform may take the form of a post suitably supported at its lower end.

The disclosed tube wringing device, forming no part of the present invention, is indicated generally at 7 and includes a pair of handle frames 8 each including a roller guard 6 disposed adjacent a roller R. The handle frames 8 are interconnected by aligned pivots 19 permitting opening and closing movement of said frames. Each frame terminates in a hand grip 9 which, when closed toward one another, biases the rollers R in a like direction. A finger operated roller key RK imparts movement to a roller which drives the remaining roller on frame journalled pins.

The present holder includes a base 2 of elongate configuration counterbored at 3 to receive fasteners 4 for platform securement. Obviously, the fasteners may vary to best suit the platform utilized. The base is transversely milled at 5 to provide a recess within which is received a roller guard 6. A clamping disc 11 bears against a roller guard 6 with a machine screw 10 engaging base 2. A base recess 16 receives a nut element 17 internally threaded at 18 for reception of a threaded latch shaft later described.

A latch is indicated at 12 shown as being of key shape having a pair of wing-like projections 13 each with a grip contactible radially extending edge 13A. A shaft 14 of the latch passes through an opening 15, formed in the base, and into recess 16 formed in the base underside. Retainers at 21 are received within slots 22 which permit movement in a direction parallel to the axis of nut element 17 and shaft 14 while preventing rotation of the nut element. Resilient means in the form of an O-ring 23, interposed between one end of the nut element and base, permits axial movement of said nut element and latch in response to outwardly exerted forces imparted by grip 9 during a tube wringer operation.

Figure 4:
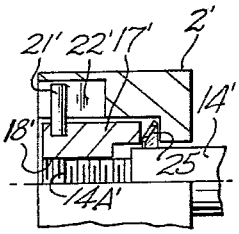
FIG. 4 is a fragmentary sectional view of the base of the holder showing a modified latch mounting.
Figure 2:
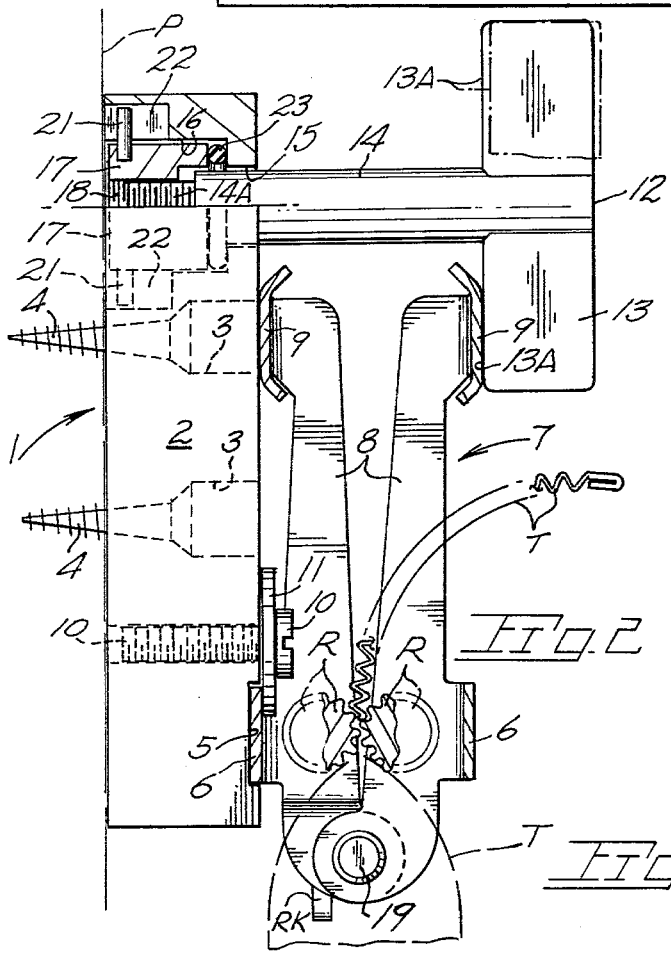
FIG. 2 is a vertical sectional view taken along line 2—2 of FIG. 1.

With attention to FIG. 4, a modified resilient mounting for a latch is provided wherein similar components are indicated by prime reference numbers. A spring washer 25 is utilized in place of an O-ring to permit nut element 17' to shift axially in response to latch imparted loads.

Figure 5:
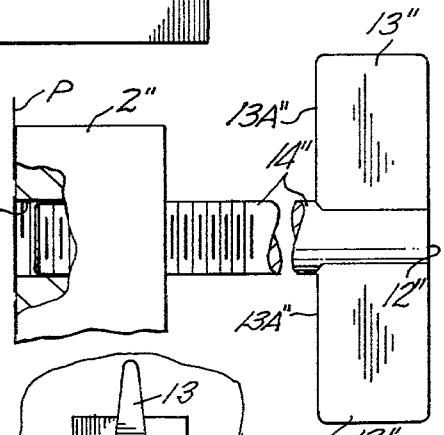
FIG. 5 is a fragmentary side elevational view of the base wherein the latch member is in direct threaded engagement with the base.
Figure 3:
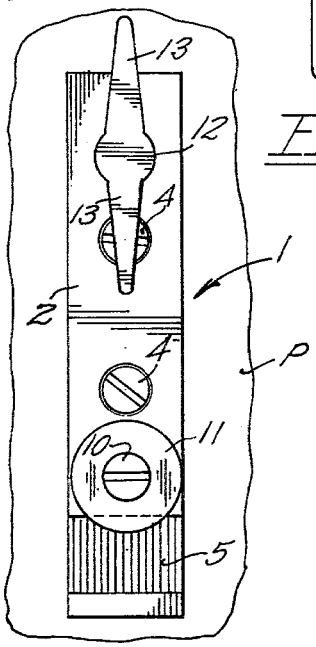
FIG. 3 is a plan view of the present holder on a reduced scale with the tube wringing device removed.

Shown in FIG. 5 is a modified holder wherein a latch shaft 14'' is in direct threaded engagement with a base 2' the latter being internally threaded at 27. While this modification of the holder does not resiliently mount the latch, the same is entirely suitable for many tube wringing operations. Similar components to those earlier described are identified by double prime reference numerals.

In use, the holder is attached to an upright or horizontal platform surface by fasteners 4 or other suitable fastening means. The wings of latch 12 are rotated so as to be transversely orientated to base 2 whereupon the outermost frame 8 is swung open about the pivot 19. The remaining frame is held securely against the outer surface of base 2 by clamping disc 11. The flat end of the collapsible tube T is located against one of the rollers and manually held there while frame 8 is swung closed and secured into place by a quarter rotation of the latch. During such closure of holder frame 8 the roller carried thereby meshes with the other roller with the roller grooves clamping the intermediate tube material adjacent the doubled back end of the tube. Adjustment of the latch should be such as to cause the rollers to firmly grip and move the tube T but not so tight that the rollers are difficult to turn. Just enough pressure to turn the tube through the rollers with positive roller-tube engagement is all that is necessary. Upon the correct adjustment being determined, further latch adjustment is normally unnecessary. In the event that roller pressure is to be varied, the latch may be partially rotated to move inwardly or outwardly with the threads thereon providing a fine adjustment and hence a fine adjustment of roller pressure. Tube spout S directs a small stream of tube discharge onto the workpiece.

While I have been shown but a few embodiments of the invention it will be apparent to those skilled in the art that the invention may be embodied still otherwise without departing from the spirit and scope of the invention.

I claim:

1. A holder for retaining a tube wringing device having pivotally joined handle frames each equipped with a roller and a handle grip, said holder permitting single handed operation of the device, said holder comprising, a base adapted for attachment to a platform, clamping means carried by said base and adapted for biased engagement with a handle frame of said device, and a rotatable latch coupled to said base and adjustable toward and away from the base, said latch having a pair of wing-like projections facilitating manual latch rotation with each projection having an edge for biased contact with a handle grip of the tube wringing device to bias same and a roller thereon toward the remaining handle and roller to compress a tube between the rollers.

2. The holder claimed in claim 1 wherein the edge of each wing-like projection is on a radial of the latch axis.

3. The holder claimed in claim 1 wherein said base and said latch are resiliently coupled to permit limited axial movement of the latch incident to handle grip movement during operation of the tube wringing device.

4. The holder claimed in claim 3 additionally including a nut element axially movable within said base, resilient means interposed between said nut element and said base biasing the latch against the handle grip of the tube wringing device.

5. The holder claimed in claim 4 wherein retainers act on said nut element to restrain same against rotation.

6. The holder claimed in claim 4 wherein said resilient means is an O-ring.

7. The holder claimed in claim 4 wherein said resilient means is a spring washer.

8. The device claimed in claim 1 wherein said base is recessed to receive a handle frame of the tube wringing device.

* * * * *